US008371322B1

(12) United States Patent
Wilson-Campbell

(10) Patent No.: US 8,371,322 B1
(45) Date of Patent: Feb. 12, 2013

(54) FOLDING CANOPY BEACH TENT

(75) Inventor: Janet Lynne Wilson-Campbell, Ocean Pines, MD (US)

(73) Assignee: Janet Lynne Wilson-Campell, MPA, Ocean Pines, MD (US)

( * ) Notice: Subject to any disclaimer, the term of this patent is extended or adjusted under 35 U.S.C. 154(b) by 183 days.

(21) Appl. No.: 12/807,261

(22) Filed: Sep. 1, 2010

Related U.S. Application Data

(60) Provisional application No. 61/276,821, filed on Sep. 17, 2009.

(51) Int. Cl.
*E04H 15/34* (2006.01)

(52) U.S. Cl. ..... 135/133; 135/137; 135/117; 135/902; 5/418

(58) Field of Classification Search ..... 135/93, 135/124, 132–133, 137, 120.3–120.4, 117, 135/115, 902, 913; 5/417–418
See application file for complete search history.

(56) References Cited

U.S. PATENT DOCUMENTS

| | | | | | |
|---|---|---|---|---|---|
| 225,372 | A | | 3/1880 | Herbert | |
| 950,394 | A | * | 2/1910 | Hohle et al. | 135/95 |
| 1,785,953 | A | | 12/1930 | Hanan | |
| 1,819,490 | A | * | 8/1931 | Weiss | 135/132 |
| 1,843,312 | A | | 2/1932 | Ames | |
| 2,036,033 | A | | 3/1936 | Fisher | |
| 2,134,879 | A | | 11/1938 | Levy | |
| 2,208,458 | A | | 7/1940 | Julian | |
| 2,290,786 | A | | 7/1942 | Varady | |
| 2,499,897 | A | | 3/1950 | Winguist | |
| 2,513,764 | A | * | 7/1950 | Vonder | 114/361 |
| 2,543,597 | A | | 2/1951 | Perry | |
| 2,615,459 | A | | 10/1952 | Adams | |
| 2,771,125 | A | | 11/1956 | Dobbins | |
| 2,811,977 | A | | 11/1957 | McClish | |
| 2,819,776 | A | | 1/1958 | Balsam | |
| 2,853,088 | A | | 9/1958 | Lamborn | |
| 2,886,047 | A | | 5/1959 | Healy | |
| 2,932,833 | A | | 4/1960 | Wambach | |
| 2,960,993 | A | * | 11/1960 | Holmstrom | 135/130 |
| 3,161,231 | A | | 12/1964 | Dawson et al. | |
| 3,241,160 | A | | 3/1966 | Escobar | |
| 3,386,456 | A | | 6/1968 | Walker | |
| 3,404,696 | A | | 10/1968 | Filho | |
| 3,404,915 | A | | 10/1968 | De Souza Filho | |
| 3,434,483 | A | | 3/1969 | Topham | |
| 3,651,847 | A | | 3/1972 | Casamassima | |
| 3,699,986 | A | | 10/1972 | Kirkham | |
| 3,847,170 | A | | 11/1974 | Anderson | |
| 3,960,161 | A | | 6/1976 | Norman | |
| 3,990,463 | A | | 11/1976 | Norman | |
| 4,063,318 | A | | 12/1977 | Nicholson | |
| 4,072,158 | A | * | 2/1978 | O'Brien et al. | 135/116 |
| 4,194,601 | A | | 3/1980 | Yellin | |
| 4,201,237 | A | | 5/1980 | Watts et al. | |
| 4,295,481 | A | | 10/1981 | Gee | |

(Continued)

*Primary Examiner* — Winnie Yip

(57) ABSTRACT

A folding canopy beach tent comprised of lightweight rod structure frame with connecting joints. This structure opens and closes. To closing structure folds down and the rods fold inward making the structure compact. The umbrella and flaccid mesh like material cover the frame structure. The material serves as a protection against sunrays and weather elements. The front flaccid mesh serves as enclosure for the structure. The side flaccid mesh allows airflow, and visibility of surroundings. The dimensions of the folding canopy beach tent provides' enough room to place a child, and other items. Stakes are used to secure the structure to the surface, therefore reducing the likelihood of the wind moving it. The stakes also secure the mesh enclosure when lowered to the ground. The structure's umbrella like material base can be directly sat or laid on. The folded canopy beach tent is carried in a carry tote with strap.

2 Claims, 9 Drawing Sheets

Front and Right Side with Mesh Enclosure

U.S. PATENT DOCUMENTS 4,379,349 A 4/1983 Larson
4,506,689 A 3/1985 Fiddler
4,646,770 A 3/1987 Lobato
4,700,731 A 10/1987 Smith
4,739,784 A 4/1988 Fast
4,748,995 A * 6/1988 Viglione ..... 135/130
4,821,353 A 4/1989 Neri
4,825,892 A 5/1989 Norman
4,930,534 A 6/1990 Hill
5,059,463 A 10/1991 Peters
5,088,514 A 2/1992 House et al.
5,116,288 A 5/1992 Kondo et al.
5,320,405 A 6/1994 Foster et al.
5,423,341 A 6/1995 Brandy
5,511,259 A 4/1996 Tarara
5,513,670 A 5/1996 Childress et al.
5,645,096 A 7/1997 Hazinski et al.
5,690,134 A 11/1997 McCauley
5,740,828 A 4/1998 Evans
5,752,537 A 5/1998 Kranzler
5,791,363 A 8/1998 Moses
5,797,412 A 8/1998 Carter
6,014,982 A 1/2000 Strevey
6,095,172 A 8/2000 Trapp et al.
6,098,349 A 8/2000 Zheng
6,109,281 A 8/2000 Lowenthal
6,942,005 B2 9/2005 Le Gette et al.
7,040,334 B2 5/2006 Pham
7,118,173 B2 * 10/2006 Kassai et al. ..... 297/184.13
7,225,822 B1 6/2007 Zheng
7,252,106 B2 8/2007 Conforti
7,302,957 B2 12/2007 Ross
7,882,850 B2 * 2/2011 Ball ..... 135/117
7,938,134 B2 * 5/2011 Adams ..... 135/124
2001/0050098 A1 * 12/2001 Lee ..... 135/156
2004/0050413 A1 * 3/2004 Cooper ..... 135/143
2008/0302403 A1 * 12/2008 Stewart ..... 135/114
2011/0146737 A1 * 6/2011 Friedman et al. ..... 135/88.13

* cited by examiner

Fig. 1A Rod Frame and Joints
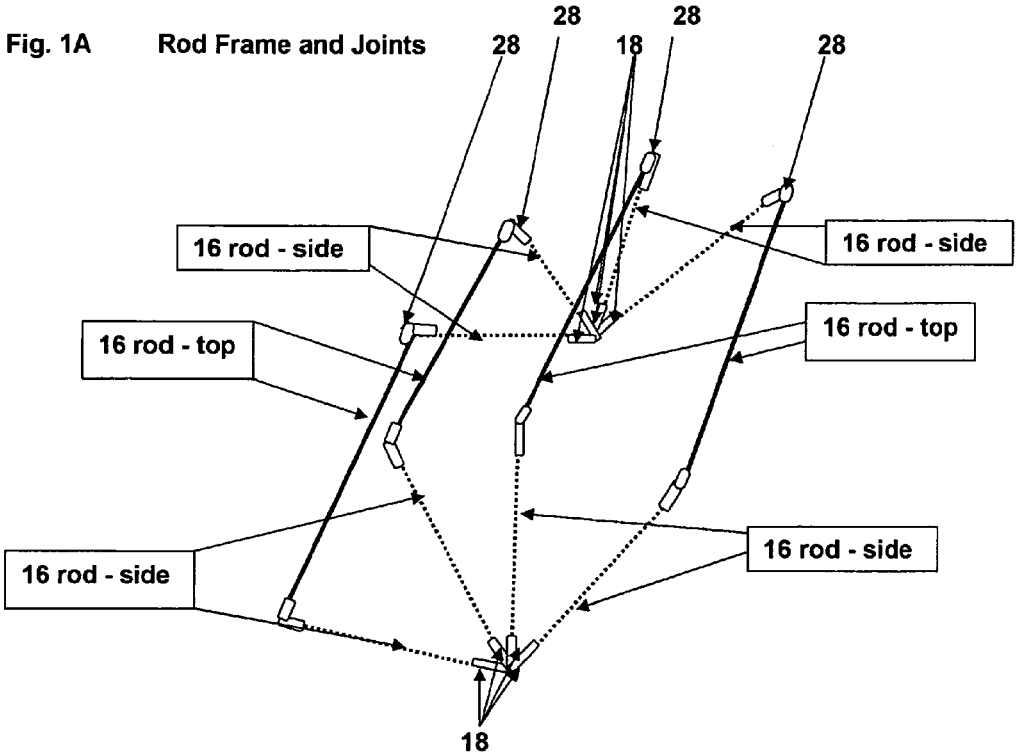
Remarks: Replaced the excessive text with reference numbers and few words to explain the rod placement being identified with "16".
Fig. 1B Part One Joint
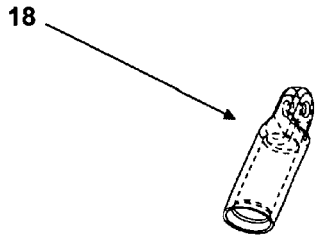
Remarks: Fig. 1B Original Fig. 1C Part Two Joint
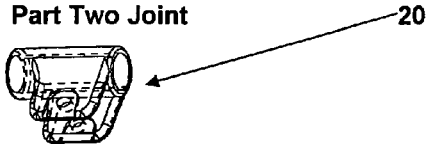
Remarks: Fig. 1C Original
Fig. 1D Dowel
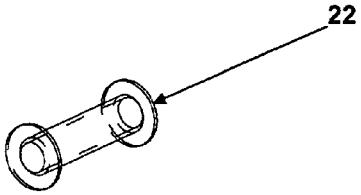
Remarks: Fig. 1D Original
Fig. 1E Part One 18, Part Two 20 Connected with Dowel 22 makes Joint 28
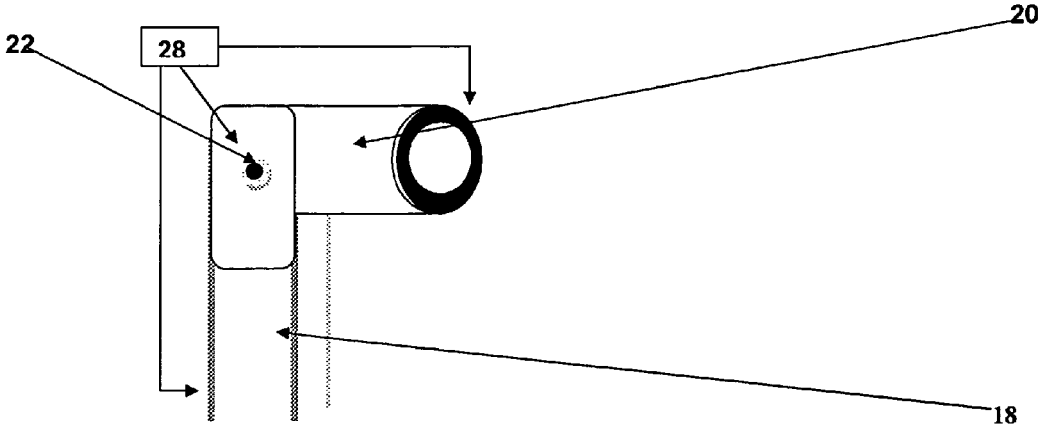
Remarks: The solid black shading was removed. Reference numbers were placed to clearly identify the joint "28" as a whole unit as well as the individual components "18", "20", "22" used to make "28".

Fig. 1F Part One Joint, Part Two Joint, and Dowel Showing Open and Folded
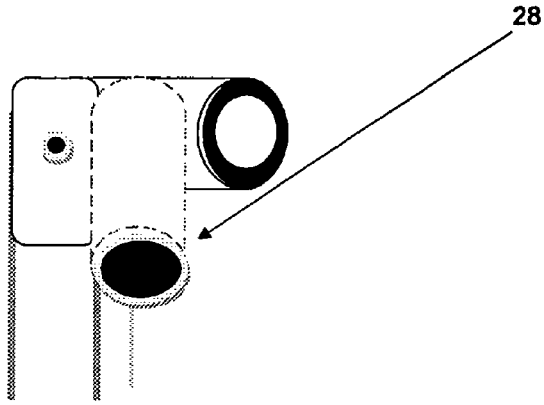
Remarks: Fig. 1F Original Fig 2A Front Strap Top View
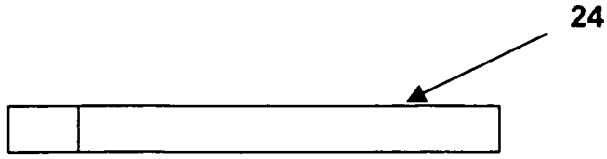
Fig 2B Front Strap Side View
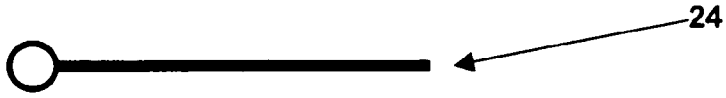
Fig 3 Secure Straps
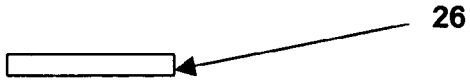
Fig 4 Base Loop
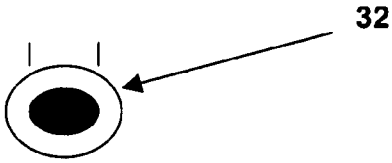
Fig. 5 Stake
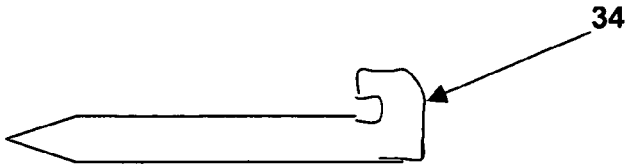

Fig 6A Front View
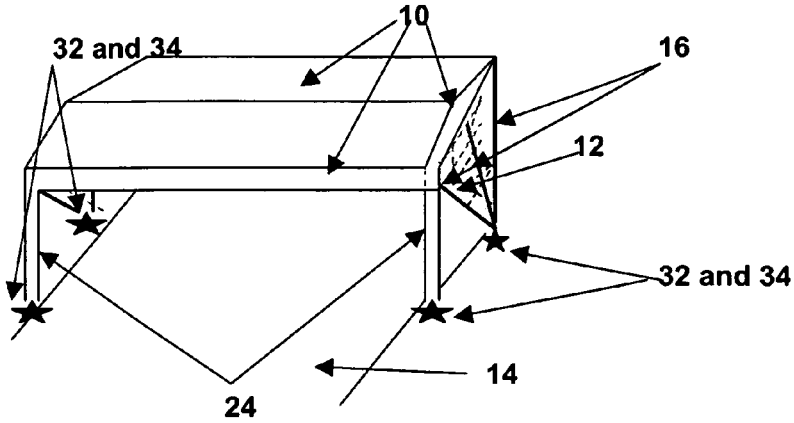
Fig 6B Right Side View
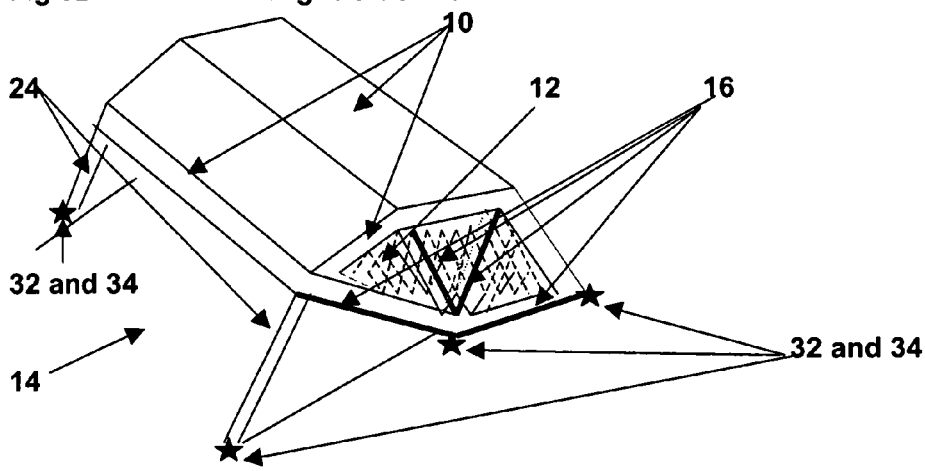
Fig 6C Left Side View
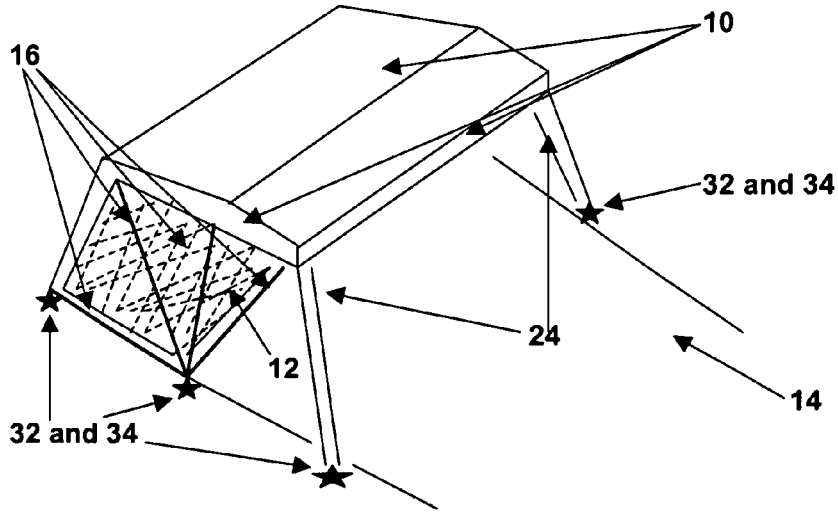

Fig 6D Back View
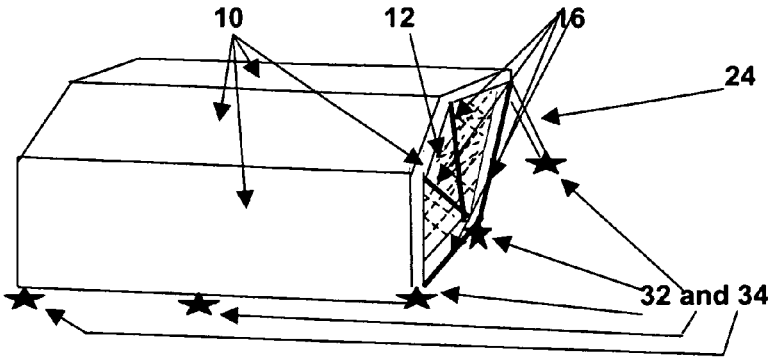
Fig 7 Rolled Up Mesh inside the Front Top and Secure Straps
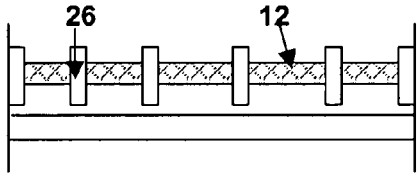
Fig 8A Front View with Mesh Enclosure
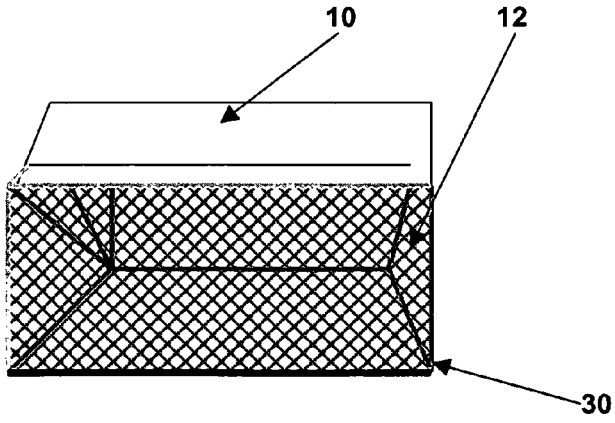

Fig. 8B Front and Right Side with Mesh Enclosure
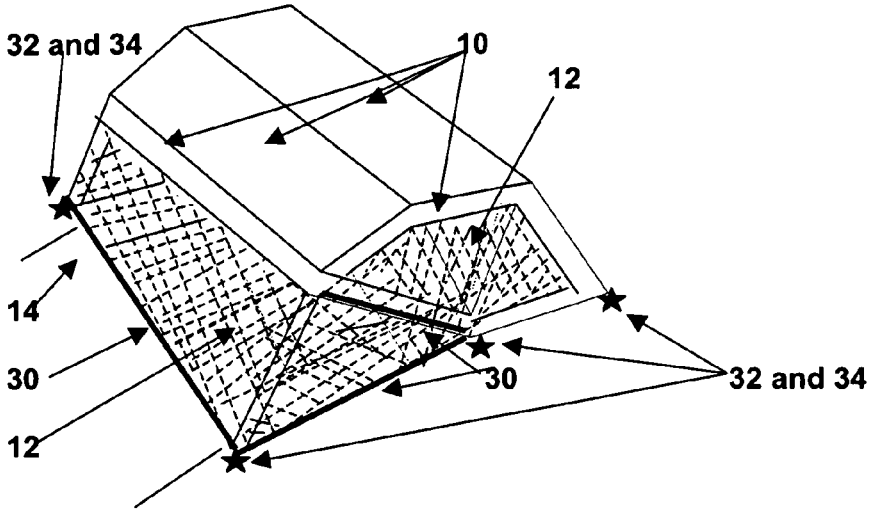
Fig. 8C Front and Left Side with Mesh Enclosure
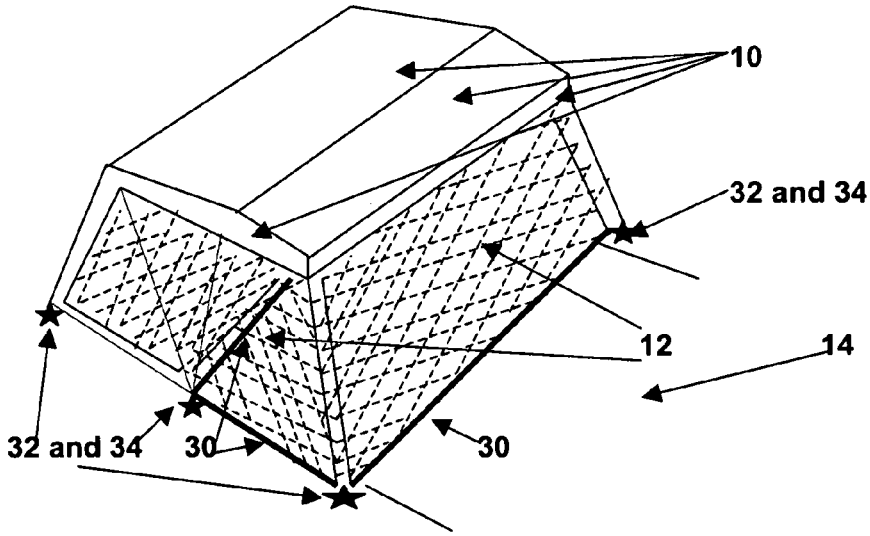

Fig. 9A Illustration of the open folding canopy beach tent being closed.
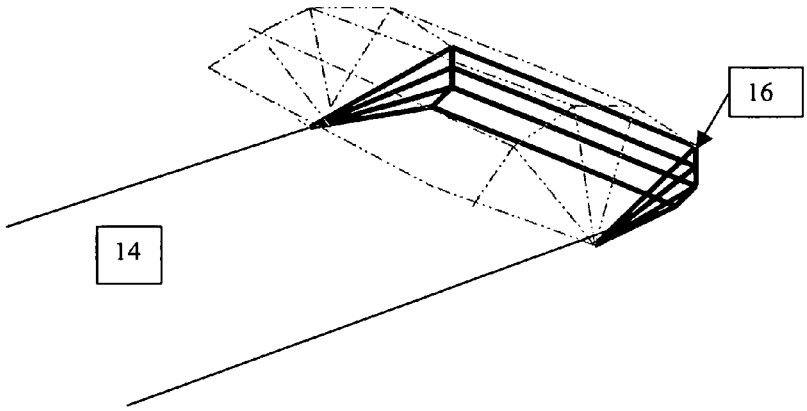
Fig. 9B Illustration of Right and Left Side Rod Frame Folding Inward
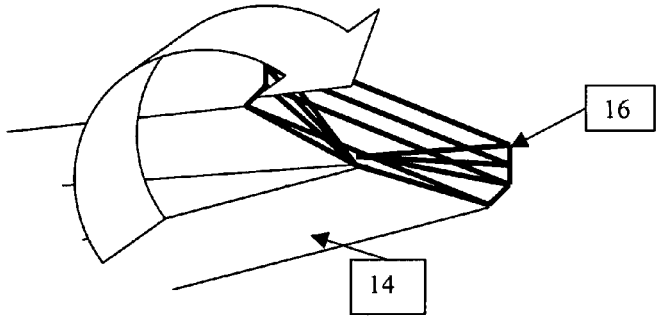
Fig. 9C Folding Beach Canopy Beach Tent Rolled Up
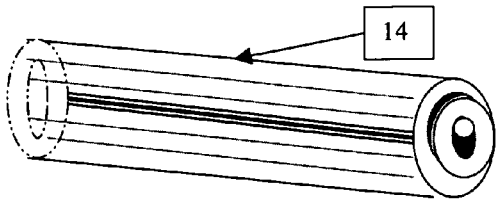

Fig. 10 Carry Tote for Folding Canopy Beach Tent
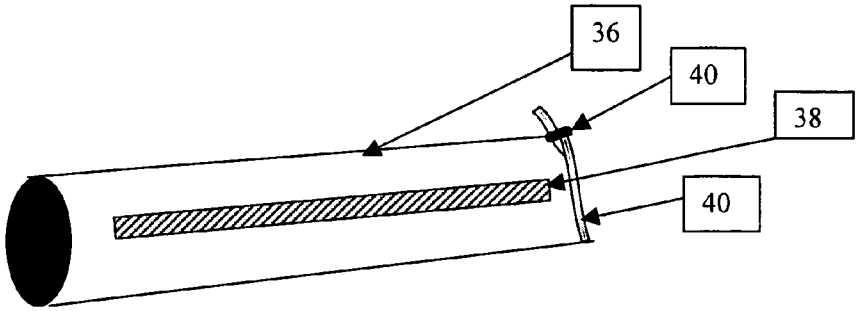
Fig. 11 Carry Tote Handle
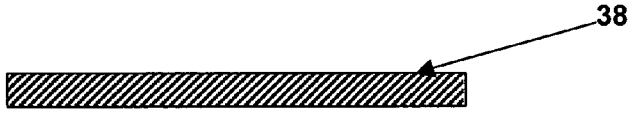
Fig. 12 Drawstring or Draw Cord
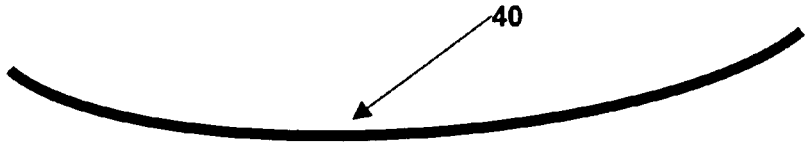
Fig. 13 Cord Lock
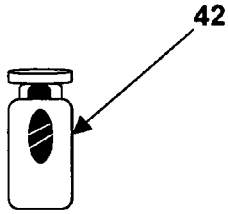

FOLDING CANOPY BEACH TENT

CROSS-REFERENCE TO RELATED APPLICATIONS

Application No. 61/276,821 filed Sep. 17, 2009

FEDERALLY SPONSORED RESEARCH

Not Applicable

SEQUENCE LISTING OR PROGRAM

Not Applicable

BACKGROUND

1. Field of Invention

This invention is related to folding tents and canopies with attached material to lay a beach towel, material or other items on, as well as a carry tote with arm strap to carry the collapsed, folded, and wrapped invention. Specifically to be used on beaches to reduce sun exposure and weather elements while offering material to sit or lay on, as well as an enclosure option it give an appearance of security to its contents. This invention allows a stake like object to pass through a base loop secured to the base of the invention and push into the beach or ground surface. Therefore, the stake secures the invention to the beach or ground surface doing so reduces the likelihood of the invention being moved or blown away by the wind.

2. Prior Art

Standard umbrellas are heavier and long. This makes them more difficult to handle or carry on or off the beach. It can be difficult to stake the umbrella in the sand without it falling down or blowing away. High winds can pull the umbrella out of the sand therefore potentially hitting, damaging, or harming somebody. Standard umbrellas, which are on a pole in the air, do not prevent or reduce sand or other elements from hitting the person lying or sitting under it. Also, on windy days unless weighted down papers will blow or fly away while under a standard umbrella.

Standard canopy tents have small openings. This makes it difficult to place infants or young children in carrying seats through. It is difficult for the baby or toddler to get their diaper or clothes changed or fed through a small opening. Also, the small tent canopies are not secured to the sand therefore can be blown over. As the small tent canopy is completely enclosed there is a reduced amount of airflow through or in the canopy. Although shading the content it may become very warm inside the small tent canopy.

SUMMARY

In accordance, a folding canopy beach tent reduces exposure to sunrays and natural weather elements while providing practical and convenient use of the base (ground cover) material and mesh enclosure. The security of the folding canopy beach tent is set in place by the attached base loops and removable stakes. The folding canopy beach tent is compact when collapsed, folded, and wrapped. Being lightweight makes it convenient and easy to carry with the strap of the carry tote. The draw cord allows the carry tote to remain open or be securely closed. The folding canopy beach tent functions similar to a regular umbrella, tent, and beach towel. It shades or reduces the sunrays on the individuals or items under it. The base (ground cover) material can be used to lay or sit on. The mesh front and sides serve as wind resistance and indirect security of items under it. Meaning, it does not keep people from removing items from beneath the folding canopy beach tent however it makes it more noticeable when somebody other than the owner is trying to remove items from within or under it.

DRAWING

Figures

In the drawings, closely related figures have the same number but different alphabetic suffixes.

FIG. 1A is a perspective view of the rod frame and geometry placement of the joints connecting and at the end of the bottom rods.

FIG. 1B is the angle view of the Part 1 joint.

FIG. 1C is the angle view of the Part 2 joint.

FIG. 1D is the angle view of the dowel.

FIG. 1E is the angle view of the Part 1 joint (1B) and Part 2 (1C) connected together by the dowel (1D).

FIG. 1F illustrates FIG. 1E open and folding.

FIG. 2A is the top view of the front strap used to secure open the folding canopy beach tent.

FIG. 2B is the side view of 2A.

FIG. 3 is the perspective view of the secure strap for the front mesh.

FIG. 4 is the perspective view of the base loop to secure the folding canopy beach tent.

FIG. 5 is the side view of a stake.

FIG. 6A is a perspective view of the secured open folding canopy beach tent with base (ground cover) material.

FIG. 6B is a right side view of the secured open canopy beach tent with base (ground cover) material.

FIG. 6C is a left side view of the secured open canopy beach tent with base (ground cover) material.

FIG. 6D is the back and side view of the secured open canopy beach tent.

FIG. 7 is the perspective view of the mesh secured inside (under) the front top of the folding canopy beach tent umbrella like material with the secure straps.

FIG. 8A is a perspective view of the front mesh secured to the ground stakes to form an enclosure. Material edging is at the bottom and sides of the folding mesh.

FIG. 8B is a perspective view of the front and right side view of the front and side mesh secured to the ground stakes to form an enclosure. Material edging is at the bottom and sides of the folding mesh.

FIG. 8C is a perspective view of the front and left side view of the front and side mesh secured to the ground stakes to form an enclosure. Material edging is at the bottom and sides of the folding mesh.

FIG. 9A is an illustration of the open folding canopy beach tent rod frame being closed.

FIG. 9B is an illustration of the right and left side rod frames being folded inward (closed).

FIG. 9C is a perspective of the base (ground cover) material wrapped around the folded top and side rod frames.

FIG. 10 is a perspective side view of the carry tote with handle and draw cord used to secure, store, and carry the folding canopy beach tent.

FIG. 11 is a perspective view of the carry tote handle.

FIG. 12 is a perspective view of the draw cord used to open and close the tote carry case.

FIG. 13 is a perspective view of the draw cord lock allows the draw cord to remain open or securely closed.

DRAWINGS - REFERENCE NUMERALS

| | | | |
|---|---|---|---|
| 10 | umbrella like UV protected material | 12 | mesh |
| 14 | base (ground cover) material | 16 | rod |
| 18 | Part 1 joint | 20 | Part 2 joint |
| 22 | dowel | 24 | front strap |
| 26 | secure strap | 28 | joint |
| 30 | material edging | 32 | base loop |
| 34 | stake | 36 | carry tote |
| 38 | carry tote handle | 40 | draw cord |
| 42 | cord lock | | |

DETAILED DESCRIPTION OF THE INVENTION

The present invention will now be described more fully in detail with reference to the accompanying drawings, which the preferred embodiments of the invention are shown. This invention should not, however, be construed as limited to the embodiments set forth herein; rather, they are provided so that this disclosure will be complete and will fully convey the scope of the invention to those skilled in the art.

FIG. 1A is a perspective view of the rod frame and geometry of the joints connecting each rod end. The diameter for the eight side fiberglass rods 16 are ¼" by 24 and the four top fiberglass rods 16 are ¼" by 36" will be given here for purposes of illustration only. It is understood that the rods 16 according to the invention is not limited to a ¼" by 24 or ¼" by 36" fiberglass rods. The rod is made of fiberglass material will be given here for the purpose of illustration. It is understood that the rod according to the invention is not limited to fiberglass material. The top end of each 24" side rod 16 is connected to each top 36" rod end 16 by pivoting joints 28 (FIGS. 1E and 1F) which allow the rods to pivot to open (outward) and close (inward) (FIG. 1F). A single joint 18 is placed on the bottom end of the side 24" rod 16 (FIG. 1B). A dowel 22 (FIG. 1D) is placed through the hole of the joint 18 (FIG. 1B) to secure the bottom four rods 16. The four secure base rods 16 each side of frame base can pivot open (upward) and down (collapse). Obviously, those skilled in the art may develop a wide variety of rods, joints, folding joints, pins, fasteners, or other structures that may be used to form the frame and connection and such alternatives are considered within the scope of the present invention.

FIG. 1B is the angled view of the Part 1 joint 18. In the illustration the joint 18 is cylindrical; however in alternative embodiments it may have other shapes or forms. The internal diameter of 18 is configured to the outside diameter of the rod 16. To enable the folding canopy beach tent to fold inward and outward the Part 1 joint 18 is adjoined to the Part 2 joint 20 with a dowel 22 (FIG. 1E; also illustrated in FIGS. 1A, 9A, and 9B). Also, Part 1 joint 18 is used at the end (base) of the rod 16 (FIG. 1A). With the connection of the Part 1 joints 18 the folding canopy beach tent rod 16 frame is able to pivot open and collapsed (closed) (FIG. 1A and FIG. 9A). The Part 1 joint is made of M90 material will be given here for the purpose of illustration. It is understood that the Part 1 joint according to the invention is not limited to the M90 material. Obviously, those skilled in the art may develop a wide variety of joints; end caps or other structures that may be used to secure the end of the frame, folding ability of the frame and connections and such alternatives are considered within the scope of the present invention.

FIG. 1C is the angle view of the Part 2 joint 20. The internal diameter of 20 is configured to the outside diameter of the rod 16. The construction of the base of Part 2 joint allows the Part 1 18 joint to be housed or inserted and secured with a dowel 22 (FIG. 1E). The eight secure folding joints 28 (four on each side of the rod 16 frame) (FIGS. 1E and 1F) allow the rods 16 to pivot to open (outward) and close (inward) (FIG. 9A). The Part 2 joint is made of M90 material will be given here for the purpose of illustration. It is understood that the Part 2 joint according to the invention is not limited to the M90 material. Obviously, those skilled in the art may develop a wide variety of joints; connecting caps or other structures that may be used to create the folding ability of the frame and connection and such alternatives are considered within the scope of the present invention.

FIG. 1D is the angle view of the dowel 22. The external diameter and length is based on the internal diameter and length of the Part 1 joint 18 and Part 2 joint 20. The dowel is used to adjoin Part 1 joint 18 and Part 2 joint 20 to create a folding joint 28 (FIGS. 1E and 1F). The dowel 22 is also used to adjoin four Part 1 joints 18 to secure the rod 16 frame base and allowing it to pivot open (up) and collapse (close) (FIGS. 1A and 9A). The dowel 22 is made of copper material will be given here for the purpose of illustration. It is understood the dowel according to the invention is not limited to copper material. Obviously, those skilled in the art may develop a wide variety of rivets, locks or other structures that may be used to adjoin the Part 1 joints 18 and Part 2 joints 20 and such alternatives are considered within the scope of the present invention.

FIG. 1E is the angle view of Part 1 joint 18, Part 2 joint 20, and dowel 22 creates a folding joint 28. The folding joint 28 is used at the eight top corners of the folding canopy beach tent rod 16 frame. The internal diameter of the folding joint 28 is configured to the outside diameter of the rod 16. The eight secure folding joints 28 allow the rod 16 frame to pivot to open (outward) and close (inward) (FIG. 1A and FIG. 9A). Obviously, those skilled in the art may develop a wide variety of folding joints; connectors or such alternatives are considered within the scope of the present invention.

FIG. 1F illustrates FIG. 1E open and folding.

FIG. 2A is the top view of the front strap 24 used to secure the front of the folding canopy beach tent to the sand or ground. It is constructed of the umbrella like base material (14). Its top of 24 is sewn to the inside top front of the folding beach canopy tent (FIGS. 6A thru 6D). The bottom of 24 has a loop (FIG. 2B) sewn enabling the folding canopy beach tent to be secured to the beach or ground with a stake 34 like object (FIG. 5; also illustrated 6A thru 6D and 8B thru 8C). The front strap is made of umbrella like polyester material will be given here for the purpose of illustration. It is understood that the front strap according to the invention is not limited to the umbrella like polyester material. Obviously, those skilled in the art may utilize a wide variety of fabrics and such alternatives are considered within the scope of the present invention.

FIG. 2B is the side view of the front strap 24 (FIG. 2A).

FIG. 3 is the perspective view of the secure strap 26 for the enclosure mesh 12. The secure strap 26 is located inside the top front of the folding canopy beach tent. The secure strap 26 is made of nylon material will be given here for the purpose of illustration. It is understood the secure strap 26 according to the invention is not limited to nylon material. When the enclosure mesh 12 is rolled up it is secured in place by the secure straps 26 (FIG. 7; also illustrated 6A thru 6D). For the purpose of illustration six pairs of secure straps 26 (FIG. 7) are used. It is understood that secure straps 26 according to the invention is not limited to six pairs. Obviously, those skilled in the art may utilize a wide variety of fabrics; materials, fasteners, hooks and such alternatives to secure the enclosure mesh are considered within the scope of the present invention.

FIG. 4 is the perspective view of the base loop 32 to secure the base of the folding canopy beach tent to the sand or ground. The loop is constructed of the umbrella like base material (14). The base loop is sewn at the base of the folding canopy beach tent. For the purpose of illustration three loops are placed in the back (FIG. 6D). For the purpose of illustration one loop is placed on each side of the folding canopy beach tent beside the joined Part 1 joints 18 (FIG. 6A). The stake 34 (FIG. 5) is inserted through the base loop 32 securing the folding canopy beach tent to the beach or ground. The base loop 32 is made of umbrella like base polyester material 14 will be given here for the purpose of illustration. It is understood that the base loop 32 according to the invention is not limited to the umbrella like base polyester material 14. Obviously, those skilled in the art may utilize a wide variety of fabrics, fasteners, hooks, and other structures to secure the invention to the beach or ground surface and such alternatives are considered within the scope of the present invention.

FIG. 5 is a side view of a stake 34. For the purpose of illustration seven stakes 34 are inserted through the base loops 32 to secure the folding canopy beach tent frame base to the beach or ground (FIGS. 6A the 6 D and 8B thru 8C). The stake 34 is made of ABS material and is 9" in length will be given here for the purpose of illustration. It is understood that the stake 34 according to the invention is not limited to the ABS material or 9" length. Obviously, those skilled in the art may utilize a wide variety of stakes, fasteners, and other structures to secure the invention to the beach or ground surface and such alternatives are considered within the scope of the present invention.

FIG. 6A. is a perspective front view of the open folding canopy beach tent. In the illustration the front edge (hangover), top, and right side top edge (hangover) of the invention is covered with umbrella like UV protected material 10. The umbrella like material is made polyester material with silver undercoating for UV protection will be given here for the purpose of illustration. It is understood that the umbrella like UV protected material 10 according to the invention is not limited to the umbrella like polyester material with silver undercoating for UV protection. The illustration shows the right side mesh 12. It is understood that the mesh is made of polyester material will be given here for the purpose of illustration only. It is understood that the mesh according to the invention is not limited to the polyester material. The side mesh 12 is sewn or secured to the inside of the umbrella like material 10 side edge (hangover) and side frame rods 16. In the illustration the side frame rods 16 (FIG. 1A), front straps 24 (FIGS. 2A-2B), base (ground cover) material 14, base loops 32 (FIG. 4.), and stakes 34 (FIG. 5) are displayed. Obviously, those skilled in the art may utilize a wide variety of fabrics and other materials to cover the rod frame structure of the invention and such alternatives are considered within the scope of the present invention.

FIG. 6B is a perspective right side view of the open folding canopy beach tent. The invention front edge (hangover), top, and right side edge (hangover) around the right side top and back is covered with umbrella like UV protected material 10. In the illustration the right side of the invention is covered with mesh 12. The base (ground cover) material 14 is similar to umbrella like material 10 with the option of being non-UV protected. The base (ground cover) material is made of polyester non-UV protected will be given here for the purpose of illustration. It is understood that the base (ground cover) material 14 according to the invention is not limited to the umbrella like polyester non-UV protected material. In the illustration the base (ground cover) material 14 and edging around the right side bottom frame rod 16 is covered with the base (ground covered) material 14. The side mesh 12 is sewn or secured to the inside of the inside (hangover) of the umbrella like material 10 and base (ground cover) material 14. In the illustration the side frame rods 16 (FIG. 1A), front straps 24 (FIGS. 2A-2B), base (ground cover) material 14, base (ground cover) loops 32 (FIG. 4.), and stakes 34 (FIG. 5) are identified. Obviously, those skilled in the art may utilize a wide variety of fabrics and other materials to cover the rod frame structure of the invention and such alternatives are considered within the scope of the present invention.

FIG. 6C is a perspective left side view of the open folding canopy beach tent. In the illustration the front edge (hangover), top, and left side edge (hangover) around the left side top and back is covered with umbrella like UV protected material 10. In the illustration the left side of the invention is covered with mesh 12. The base (ground cover) material 14 is similar to umbrella like material 10 with the option of being non-UV protected. In the illustration the base (ground cover) material 14 and edging around the left side frame rod 16 bottom is covered with the base (ground covered) material 14. The side mesh 12 is sewn or secured to the inside of the inside (hangover) of the umbrella like material 10 and base (ground cover) material 14. In the illustration the side frame rods 16 (FIG. 1A), front straps 24 (FIGS. 2A-2B), base (ground cover) material 14, base (ground cover) loops 32 (FIG. 4.), and stakes 34 (FIG. 5) are identified. Obviously, those skilled in the art may utilize a wide variety of fabrics and other materials to cover the rod frame structure of the invention and such alternatives are considered within the scope of the present invention.

FIG. 6D is a perspective back view of the open folding canopy beach tent. In the illustration rod 16 frame side top and side edge rod 16 frame (hangover) is covered with umbrella like UV protected material 10 and the bottom edge rod 16 frame is covered with base (ground cover) material 14. In the illustration the side of the invention is covered with mesh 12. The side mesh 12 is sewn or secured to the inside of the inside (hangover) of the umbrella like material 10 and base (ground cover) material 14. In the illustration the side frame rods 16 (FIG. 1A), front straps 24 (FIG. 2A-2B), base loops 32 (FIG. 4.), and stakes 34 (FIG. 5) are identified. Obviously, those skilled in the art may utilize a wide variety of fabrics and other materials to cover the rod frame structure of the invention and such alternatives are considered within the scope of the present invention.

FIG. 7 is a perspective view of the enclosure mesh 12 rolled up and secured to the inside front top of the folding canopy beach tent. In the illustration six (pairs) secure straps 26 are displayed as securing the enclosure mesh 12 to the inside front top of the folding canopy beach tent. The secure straps 26 are sewn or secured to the inside front top of the folding canopy beach tent. In this illustration six pairs of secure straps 26 are tied to secure the enclosure mesh 12 to the inside top of the canopy folding beach tent. Obviously, those skilled in the art may develop a wide variety of buttons, fasteners, or other structures that may be used to secure the enclosure mesh in place and such alternatives are considered within the scope of the present invention.

FIG. 8A is a perspective front view of the open canopy beach tent displaying the enclosure mesh 12 down. In the illustration the front edge (hangover) and top are covered with umbrella like UV protected material 10. The top of the enclosure mesh 12 is sewn or secured to the inside top front (FIG. 7) of the folding canopy beach tent. When the secure straps 26 are released the enclosure mesh unrolls to the length to touch the sand or ground surface. The bottom end of the enclosure mesh has material edging 30 sewn or secured around the base to reduce tearing, fraying, and maintain the shape of the enclosure mesh. Obviously, those skilled in the art may utilize a wide variety of fabrics and other materials to cover the rod frame structure, form an enclosure, or create a binding seam of the invention and such alternatives are considered within the scope of the present invention.

FIG. 8B is a perspective front and right view of the open canopy beach tent with the enclosure mesh 12 released and unrolled down. In the illustration the front edge (hangover) and top are covered with umbrella like UV protected material 10. The top of the enclosure mesh 12 is sewn or secured to the inside top front of the folding canopy beach tent. FIG. 8B is the illustration of FIG. 6B when the secure straps 26 are released the enclosure front and front corners mesh 12 are released and lowered to ground level. The bottom end of the enclosure mesh 12 has material edging 30 sewn or secured around the base to reduce tearing, fraying, and maintain the shape of the enclosure mesh 12. In the illustration base (ground cover) material 14, base loops 32 (FIG. 4.), and stakes 34 (FIG. 5) are displayed. Obviously, those skilled in the art may utilize a wide variety of fabrics and other materials to cover the rod frame structure, form an enclosure, or create a binding seam of the invention and such alternatives are considered within the scope of the present invention.

FIG. 8C is a perspective front and left view of the open canopy beach tent with the enclosure mesh 12 released and unrolled down. FIG. 8C is the illustration of FIG. 6C when the secure straps 26 are released the enclosure front mesh 12 and front corners mesh 12 are released and lowered to ground level. The bottom end of the enclosure mesh 12 has material edging 30 sewn or secured around the base to reduce tearing, fraying, and maintain the shape of the enclosure mesh. In the illustration base (ground cover) material 14, base loops 32 (FIG. 4.), and stakes 34 (FIG. 5) are displayed. Obviously, those skilled in the art may utilize a wide variety of fabrics and other materials to cover the rod frame structure, form an enclosure, create a binding seam, or securing invention to the beach or ground of the invention and such alternatives are considered within the scope of the present invention.

FIG. 9A is an illustration of the open folding canopy beach tent rod 16 frame being collapsed (closed). FIG. 9A is the illustration of FIG. 1A converting the rod 16 frame structure of the folding canopy beach tent from an open position to a collapsed (closed) position. In the illustration is the base (ground cover) material 14. Collapsing of the top structure allows the user to sit on the base (ground cover) material 14 while obtaining full sunrays and weather exposure, if so desired.

FIG. 9B is an illustration of the open right and left side rod frames being folded closed (inward). To store the folding canopy beach tent the rod 16 frame is collapsed (FIG. 9A). For the purpose of this illustration the two sets of four rod 16 frame sides are folded inward. As the base (ground cover) material 14 is secured to the base (bottom) rod 16 frame the base (ground cover) material 14 will also fold inward.

FIG. 9C is a perspective view of the base (ground cover) material 14 wrapped (rolled) around the collapsed (FIG. 9A) and folded (FIG. 9B) folding canopy beach tent rod 16 frame. The wrapped folding canopy beach tent is then stored in the carry tote 36 (FIG. 10).

FIG. 10 is a perspective side view of the folding canopy beach tent carry tote 36. The wrapped folding canopy beach tent (FIG. 9C) is stored, secured, and carried in the carry tote 36. For the purpose if this illustration the carry tote is made of the base (ground cover) material. The width and length dimensions' of the carry tote 36 is calculated on the size of the wrapped folding canopy beach tent. The carry tote 36 has a carry handle 38 (FIG. 11) sewn or secured to a side of the carry tote 36. To secure the folding canopy beach tent in the carry tote a draw cord 40 (FIG. 12) is sewn in one end of the carry tote 36. A cord lock 42 (FIG. 13) will be inserted on the draw cord 40 (FIG. 12) enabling the open end of the carry tote 36 to be open or secured closed. Obviously, those skilled in the art may develop a wide variety of carry totes to store, secure, and carry the folding canopy beach tent and such alternatives are considered within the scope of the present invention.

FIG. 11 is a perspective top view of the carry tote handle 38. The width and length dimensions' of the carry tote handle is calculated on the size of the carry tote (FIG. 10). The carry tote handle 38 is made of polyester material will be given here for the purpose of illustration. It is understood that the carry tote handle according to the invention is not limited to the polyester material. Obviously, those skilled in the art may develop a wide variety of carry totes handles to placed on the carry tote and such alternatives are considered within the scope of the present invention.

FIG. 12 is a perspective top view of the draw cord 40. The width and length dimensions' of the draw cord is calculated on carry tote's 36 (FIG. 10) open-end diameter. The draw cord 40 is made of polyester material will be given here for the purpose of illustration. It is understood that the draw cord according to the invention is not limited to the polyester material. Obviously, those skilled in the art may develop a wide variety of drawstrings; fasteners, closures and such alternatives are considered within the scope of the present invention.

FIG. 13 is a perspective front view of the cord lock 42. The width and length dimensions' of the draw lock 42 is calculated on thickness diameter of the draw cord 40 (FIG. 12). The cord lock is made of ABS material will be given here for the purpose of illustration. It is understood that the cord lock 42 according to the invention is not limited to the ABS material. Obviously, those skilled in the art may develop a wide variety of fasteners; locks, closures and such alternatives are considered within the scope of the present invention.

It is understood that the present invention is not limited to the embodiments described above. Variations in the construction of the folding canopy beach tent material, frame, fabric structure supported by the frame may be contemplated by one skilled in the art; without limiting the intended scope of the invention herein disclosed and as defined by the following claims.

ADVANTAGES

The folding canopy beach tent eliminates the need to carry an umbrella when a person carries an umbrella primary to shade their face or shade a baby, toddler, or small child. The folding canopy beach tent eliminates the need to carry a beach towel as it has a material base. When a person is lying under the folding canopy beach tent they are able to see through both sides and the front. The mesh creates a wind resistance enabling items to remain under the folding canopy beach tent without the wind blowing them away. The mesh reduces the sand or particles being blown in the face of the person lying under the folding canopy beach tent.

When items are placed under the folding canopy beach tent and the front mesh is rolled down and attached to the sides it provides a more visual security of property. Meaning, a person would have to actually open the sides of the folding canopy beach tent to have access to the items located under the folding canopy beach tent. The folding canopy beach tent enables parents or guardians easier access to the baby, toddler, or small child to change their diaper, clothes, feed, or attend to their needs. As the folding canopy beach tent is secured by stakes inserted through base loops to the sand or ground reduces the likelihood of it moving or blowing away during high winds.

The folding beach canopy tent purpose is for convenience when going to the beach and other outside events or activities. As it is a two in one it reduces the need take a large umbrella and ground cover. The folding canopy beach tent is lightweight, folds, and is carried in a carry tote that can be opened or securely closed through the use of the draw cord and cord lock. The tote has an arm strap freeing the hands to carry or hold other items. The folding canopy beach tent reduces the sunrays, sand, or wind on the person lying under it.

The folding canopy beach tent creates easier accessibility to the baby, toddler, or small child lying under it. Folding the front mesh down and attaching it to the side mesh reduces the sun rays, sand, and wind on the child, yet enables the child to be easily visibly seen, and is easily assessable to. The raised canopy beach tent allows a baby's carrying seat to fit under the opened folding canopy beach tent. Also, the raised canopy beach tent allows a person to slightly sit up, lean up, or sit in a low to the ground beach like chair to read or write without the wind blowing the papers away.

CONCLUSION, RAMIFICATIONS, AND SCOPE

Accordingly, the reader will see that the folding canopy beach tent serves as a shade, reduction of direct sunrays, while the mesh serves as a wind resistant and reduces elements such as but not limited to sand while under folding canopy beach tent. The wider front gives easier accessibility to a baby, toddler, small child, or items lying under the folding canopy beach tent. When the front mesh is lowered and attached to the side mesh it secures the items from blowing away or being easily picked up by others. Furthermore, the folding canopy beach tent has the additional advantages in that

- it can be used by all ages; infants, teenagers, adults, and seniors.
- it is compact and lightweight to carry.
- it permits the production in a variety of colors without requiring the manufacturer to use a separate facility for materials.
- it permits the production in a variety of sizes without requiring the manufacturer to use a separate facility to produce invention.
- it permits the production in a variety of shapes without the requiring the manufacturer to use a separate facility to produce invention.
- it is convenient as it does not require accessibility (excluding placing stakes in sand or ground to secure it).
- It helps to protect the skin from harmful sunrays and weather elements.
- it makes easier accessibility to fed or change a baby, toddler, or small child.
- its mesh serves a wind resistant so papers or objects do not easily blow way.
- its secured in the sand or ground so it will not blow away in high winds.
- it can serve as a two in one-umbrella and laying on base (ground cover) material (if a beach towel is not had) or a beach towel can be laid on the base (ground cover) material.
- the folding canopy beach tent base (ground cover) material can be used like a beach towel with or without the canopy open.
- it enables an individual not to have to sit directly on the surface since a low to the ground beach like chair or other sitting or laying embodiment can fit or be placed under the folding canopy beach tent.

Although the description above contains much specificity these should not be construed as limiting the scope of the embodiment but as merely providing illustrations of some of the presently preferred embodiments. Thus the scope of the embodiment should be determined by the appended claims and their legal equivalents, rather than by the examples given.

I claim:

1. A folding canopy beach tent comprising:

an extended base ground cover;

a folding canopy top structure being permanently affixed to approximately half of a length of the extended base ground cover;

said folding canopy top structure comprising:

a folding frame structure having a plurality of U-shaped rod members, each said rod member having a top rod having two ends, and two side rods each having an upper end and a lower end, said two ends of said top rod being pivotally connected to said upper ends of said two side rods by pivoting corner joints, each said pivoting corner joint including a single joint and a part two joint being pivotally connected by a dowel to allow said side rods being pivoted relative to the top rod in inward and outward directions; said lower ends of said side rods each having a single joint being pivotally connected together by a base joint to allow the two side rods of the folding frame structure being pivoted in forward and backward directions; said base joint of the folding frame structure being affixed to approximately half the length of the extended base ground cover;

a flexible cover covering said folding frame structure to form the folding canopy top structure when the tent is erected, the flexible cover comprises top and back panels made of an opaque plastic material covering the top rods of the frame structure and secured to a back end of the extended base ground cover; side panels made of a flaccid mesh material covering both side rods of the folding frame structure and secured to two sides of the extended base ground cover; and an additional section of flaccid mesh material to create a front and side corner enclosure of the canopy top structure; wherein said folding canopy top structure is trihedral sided with a cornice top, a closed back side, and an opened and closed front side; and wherein, the extended base ground cover provides a rectangular in shape surface to allow to sit on in an upright position or lay on in a horizontal position for partial sun expose with the foldable canopy top structure in an open and erected position at the approximately half the length of the extending base ground cover, or optional full sun exposure when the folding canopy top structure is folded backward in open position;

wherein the canopy beach tent is securable to a surface, ground or beach, by stakes to resist the wind moving it; and wherein the folding canopy top structure is foldable inward and backward in a parallel flattened position, with a front portion of the extended base ground cover wrapping around the folded structure into a stored position.

2. The folding canopy beach tent according to claim 1, wherein said folding canopy top structure is permanently affixed to approximately half the length of the extended base ground cover, with said approximate half of the extended base ground cover sewn to the side and back panels of the folding canopy top structure provides an area to sit or lay for partial sun exposure when the folding canopy top structure is in the open position.

* * * * *